US012736257B2

(12) United States Patent
Su et al.

(10) Patent No.: US 12,736,257 B2
(45) Date of Patent: Sep. 15, 2026

(54) CONDENSER

(71) Applicants: York (Wuxi) Air Conditioning and Refrigeration Co., Ltd., Wuxi (CN); Johnson Controls Tyco IP Holdings LLP, Milwaukee, WI (US)

(72) Inventors: Xiuping Su, Wuxi (CN); Li Wang, Wuxi (CN)

(73) Assignees: York (Wuxi) Air Conditioning and Refrigeration Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 183 days.

(21) Appl. No.: 18/278,804

(22) PCT Filed: Feb. 23, 2022

(86) PCT No.: PCT/CN2022/077360
§ 371 (c)(1),
(2) Date: Aug. 24, 2023

(87) PCT Pub. No.: WO2022/179511
PCT Pub. Date: Sep. 1, 2022

(65) Prior Publication Data

US 2024/0142147 A1 May 2, 2024

(30) Foreign Application Priority Data

Feb. 24, 2021 (CN) ..... 202110208465.6

(51) Int. Cl.
*F25B 39/04* (2006.01)

(52) U.S. Cl.
CPC ..... *F25B 39/04* (2013.01)

(58) Field of Classification Search
CPC ..... F28D 7/1607; F28D 3/02; F28D 7/1638; F28F 25/04; F28F 2009/222;
(Continued)

(56) References Cited

U.S. PATENT DOCUMENTS 8,863,551 B2 * 10/2014 de Larminat ..... F28D 3/02 62/525
2002/0046572 A1 4/2002 Iritani et al.
(Continued)

FOREIGN PATENT DOCUMENTS

CN 201203306 Y 3/2009
CN 202928219 U 5/2013
(Continued)

OTHER PUBLICATIONS

PCT International Search Report for PCT Application No. PCT/CN2022/077360, mailed May 10, 2022, 4 pgs.
(Continued)

*Primary Examiner* — Len Tran
*Assistant Examiner* — Kamran Tavakoldavani
(74) *Attorney, Agent, or Firm* — Fletcher Yoder, P.C.

(57) ABSTRACT

A condenser includes first, second, and third heat exchange tube sets, a pair of first baffles, a second baffle, and a third baffle. The second and third heat exchange tube sets are arranged at two sides of the first heat exchange tube set, each pair of first baffles is respectively adjacent to the two sides of the first heat exchange tube set, the second baffle is adjacent to one side of the second heat exchange tube set proximate the first heat exchange tube set, and the third baffle is adjacent to one side of the third heat exchange tube set proximate the first heat exchange tube set. The baffles are configured to cause the first heat exchange tube set to receive refrigerant from a refrigerant inlet, and cause the second and third heat exchange tube sets to receive the refrigerant from the first heat exchange tube set.

17 Claims, 7 Drawing Sheets

(58) Field of Classification Search
CPC ..... F25B 39/028; F25B 39/02; F25B 2339/0242; F25B 2500/09
See application file for complete search history.

(56) References Cited

U.S. PATENT DOCUMENTS

| | | | | |
|---|---|---|---|---|
| 2009/0049861 | A1 | 2/2009 | Luo et al. | |
| 2016/0040917 | A1 | 2/2016 | Liu et al. | |
| 2020/0200479 | A1* | 6/2020 | Wilson | F25B 39/028 |

FOREIGN PATENT DOCUMENTS

| | | | |
|---|---|---|---|
| CN | 203629154 | U | 6/2014 |
| CN | 104515328 | A | 4/2015 |
| CN | 104748448 | A | 7/2015 |
| CN | 104764258 | A | 7/2015 |
| CN | 104990315 | A | 10/2015 |
| CN | 106288523 | A | 1/2017 |
| CN | 107806723 | A | 3/2018 |
| CN | 109269156 | A | 1/2019 |
| CN | 210921674 | U | 7/2020 |
| CN | 111928543 | A | 11/2020 |
| CN | 112033053 | A | 12/2020 |
| WO | 2011029412 | A1 | 3/2011 |

OTHER PUBLICATIONS

European Extended Search Report for EP Application No. 22758875.3, dated Feb. 12, 2025, 8 pages.

* cited by examiner

CONDENSER

CROSS-REFERENCE TO RELATED APPLICATIONS

This application is a U.S. National Stage Application of International Application No. PCT/CN2022/077360, entitled "CONDENSER," filed Feb. 23, 2022, which claims priority to and the benefit of Chinese Patent Application No. 202110208465.6, filed Feb. 24, 2021, each of which is hereby incorporated by reference in its entirety for all purposes.

FIELD OF THE INVENTION

The present application relates to a condenser, and more particularly, to a condenser with a high heat exchange efficiency.

DESCRIPTION OF THE RELATED ART

A conventional refrigerating system comprises an evaporator, a condenser, a throttle device, and a compressor. Shell and tube condensers are extensively used in the refrigerating and air conditioning industry, in particular on large steam compressor sets. During operations of a shell and tube condenser, a high-temperature gaseous refrigerant discharged from a compressor enters the condenser via a refrigerant inlet for heat exchange with a cooling medium flowing inside a heat exchange tube, and is condensed at the surface of the heat exchange tube. The condensate drips from the heat exchange tube on the top, layer by layer, to the bottom, enters a supercooler for supercooling, and is then discharged from a refrigerant outlet. The heat exchange efficiency of a condenser is affected by multiple factors.

SUMMARY OF THE INVENTION

The present application provides a condenser, and the heat exchange efficiency of the condenser is high.

According to a first aspect of the present application, the condenser comprises: a housing, wherein the housing comprises a cavity, the cavity has a length direction, a width direction, and a height direction, and a refrigerant inlet and a refrigerant outlet are provided on the housing; a first heat exchange tube set, a second heat exchange tube set, and a third heat exchange tube set, wherein the second heat exchange tube set and the third heat exchange tube set are arranged, in the width direction of the cavity, at two sides of the first heat exchange tube set, and a horizontal fluid channel is provided below the first heat exchange tube set; a pair of first baffles, wherein each of the pair of first baffles is, in the width direction of the cavity, respectively adjacent to the two sides of the first heat exchange tube set, a top end of each first baffle of the pair of first baffles extends to above the first heat exchange tube set and is connected with the housing, and a bottom end of each first baffle of the pair of first baffles extends to a bottom end of the first heat exchange tube set; a second baffle, wherein the second baffle is, in the width direction of the cavity, adjacent to one side of the second heat exchange tube set that is close to the first heat exchange tube set, a first vertical fluid channel is formed between the second baffle and one first baffle in the pair of the first baffles that is close to the second heat exchange tube set, the first vertical fluid channel is in communication with the horizontal fluid channel, and the second baffle extends downwardly so that the lower portion of the second baffle closes the horizontal fluid channel in the height direction of the cavity; and a third baffle, wherein the third baffle is, in the width direction of the cavity, adjacent to one side of the third heat exchange tube set that is close to the first heat exchange tube set, a second vertical fluid channel is formed between the third baffle and one first baffle in the pair of the first baffles that is close to the third heat exchange tube set, the second vertical fluid channel is in communication with the horizontal fluid channel, and the third baffle extends downwardly so that the lower portion of the third baffle closes the horizontal fluid channel in the height direction of the cavity; wherein the pair of first baffles, the second baffle, and the third baffle are configured to cause the first heat exchange tube set to receive a refrigerant from the refrigerant inlet, and cause the second heat exchange tube set and the third heat exchange tube set to receive the refrigerant from the first heat exchange tube set via the horizontal fluid channel, and the first vertical fluid channel and the second vertical fluid channel.

According to the above-described condenser, when the condenser is working, the lower portion of the second baffle and the lower portion of the third baffle are at least partially immersed in the refrigerant liquid.

According to the above-described condenser, a first accommodating space is formed between the pair of first baffles, the first heat exchange tube set is arranged in the first accommodating space, the first accommodating space has a first accommodating space inlet and a first accommodating space outlet, the first accommodating space inlet is in communication with the refrigerant inlet, and the first accommodating space outlet is in communication with the horizontal fluid channel.

According to the above-described condenser, a second accommodating space is formed between the second baffle and the housing, the second heat exchange tube set is arranged in the second accommodating space, the second accommodating space has a second accommodating space inlet, and the second accommodating space inlet is in communication with the first vertical fluid channel; and a third accommodating space is formed between the third baffle and the housing, the third heat exchange tube set is arranged in the third accommodating space, the third accommodating space has a third channel inlet, and the second accommodating space inlet is in communication with the second vertical fluid channel.

According to the above-described condenser, each of the pair of first baffles comprises a main body section and a guide section, the main body section extends in the height direction of the cavity, the top of the main body section is flush with the top of the first heat exchange tube set or exceeds the top of the first heat exchange tube set, the guide section extends upwardly from the top of the main body section and tilts toward a direction away from the first heat exchange tube set until being connected with the housing, and the guide section is disposed above the first vertical fluid channel or the second vertical fluid channel.

According to the above-described condenser, the condenser further comprises: middle guide plates, wherein vent holes are formed on the middle guide plates to allow a gas to flow through, the middle guide plates are arranged inside the first heat exchange tube set, the second heat exchange tube set, or the third heat exchange tube set, the middle guide plates comprise an inclined section, and the inclined section extends in a tilted manner upwardly from at least one of the pair of first baffles, the second baffle, the third baffle, or the housing, so as to guide a liquid refrigerant to flow along one of the pair of first baffles, the second baffle, the third baffle, or the housing.

According to the above-described condenser, the vent holes are long strips extending along an inclined direction of the inclined section.

According to a second aspect of the present application, a condenser is provided, comprising: a housing, wherein the housing comprises a cavity, the cavity has a length direction, a width direction, and a height direction, and a refrigerant inlet and a refrigerant outlet are provided on the housing; a first heat exchange tube set and a second heat exchange tube set, wherein the first heat exchange tube set is arranged at one side of the second heat exchange tube set, and a horizontal fluid channel is provided below the first heat exchange tube set; and a first baffle and a second baffle, wherein the first baffle is adjacent to the first heat exchange tube set, the second baffle is adjacent to the second heat exchange tube set, a vertical fluid channel is formed between the first baffle and the second baffle, the vertical fluid channel is in communication with the horizontal fluid channel, a top end of the first baffle extends to above the first heat exchange tube set and is connected with the housing, a bottom end of the first baffle extends to a bottom end of the first heat exchange tube set, a top end of the second baffle extends to a top end of the second heat exchange tube set, and the second baffle extends downwardly so that a bottom end of the second baffle closes the horizontal fluid channel in the height direction of the cavity; wherein the first baffle and the second baffle are configured to cause the first heat exchange tube set to receive a refrigerant from the refrigerant inlet, and cause the second heat exchange tube set to receive the refrigerant from the first heat exchange tube set via the horizontal fluid channel and the vertical fluid channel.

According to the above-described condenser, when the condenser is working, the bottom end of the second baffle is at least partially immersed in the refrigerant liquid.

According to the above-described condenser, a first accommodating space is formed between the first baffle and the housing, the first heat exchange tube set is arranged in the first accommodating space, the first accommodating space has a first accommodating space inlet and a first accommodating space outlet, the first accommodating space inlet is in communication with the refrigerant inlet, and the first accommodating space outlet is in communication with the horizontal fluid channel.

According to the above-described condenser, a second accommodating space is formed between the second baffle and the housing, the second heat exchange tube set is arranged in the second accommodating space, the second accommodating space has a second accommodating space inlet, and the second accommodating space inlet is in communication with the vertical fluid channel.

According to the above-described condenser, each of the first baffles comprises a main body section and a guide section, the main body section extends in the height direction of the cavity, the top of the main body section is flush with the top of the first heat exchange tube set or exceeds the top of the first heat exchange tube set, the guide section extends upwardly from the top of the main body section and tilts toward a direction away from the first heat exchange tube set until being connected with the housing, and the guide section is disposed above the vertical fluid channel.

According to a third aspect of the present application, a condenser is provided, comprising: a housing, wherein the housing comprises a cavity, the cavity has a length direction, a width direction, and a height direction, and a refrigerant inlet and a refrigerant outlet are provided on the housing; a first heat exchange tube set and a second heat exchange tube set, wherein the first heat exchange tube set is disposed, in the height direction of the cavity, above the second heat exchange tube set, two sides of the first heat exchange tube set in the width direction of the cavity are adjacent to the housing, and at least one side of two sides of the second heat exchange tube set in the width direction of the cavity is spaced at a distance from the housing; and at least one baffle, wherein the at least one baffle is disposed at a position close to the at least one side of the second heat exchange tube set spaced at a distance from the housing, a top end of the at least one baffle is not higher than the second heat exchange tube set in the height direction of the cavity, and a fluid space is formed between the side portion of the at least one baffle and the housing.

According to the above-described condenser, a lower portion of the at least one baffle has a connection channel that allows a liquid refrigerant to pass through.

According to the above-described condenser, the condenser further comprises: a guide plate, wherein the guide plate is arranged between the first heat exchange tube set and the second heat exchange tube set and covers the second heat exchange tube set, to guide a refrigerant liquid to flow to the fluid space, and vent holes are formed on the guide plate to allow a gaseous refrigerant to pass through.

According to the above-described condenser, the guide plate comprises an inclined section, and the inclined section extends upwardly from the one baffle and towards the center line of the second heat exchange tube set in the width direction of the cavity.

According to the above-described condenser, the vent holes are long strips extending along an inclined direction of the inclined section.

In the present application, by providing the baffles, the flow rate of the gaseous refrigerant in the condenser is increased, which facilitates the breakthrough of a liquid film on heat exchange tubes, and makes it easy for the gaseous refrigerant to diffuse to heat exchange tubes in the middle and at the bottom of the condenser, thereby improving the condensation and heat exchange efficiency.

DETAILED DESCRIPTION OF THE INVENTION

Various implementation manners of the present application will be described below with reference to the accompanying drawings that form a part of this description. It should be understood that terms used herein to indicate directions, such as "front," "rear," "up," "down," "left," "right," "inside," "outside," "top," "bottom," "forward," "reverse," "proximal," "distal," "horizontal," "longitudinal," and the like, are used to describe various example structural parts and elements of the present application, but the use of these terms herein is merely for ease of description, and these terms are determined according to the example positions shown in the accompanying drawings. Since the embodiments disclosed by the present application may be arranged according to different directions, these terms that indicate directions merely serve as the description, and shall not be regarded as limitations.

Ordinal numbers used in the present application, such as "first" and "second," are merely used for differentiation and identification, and do not have any other meanings. Unless otherwise specified, they do not indicate a particular order and do not have a particular association. For example, the term "first part" itself does not imply the existence of a "second part," and the term "second part" itself does not imply the existence of a "first part."

Figure 1:
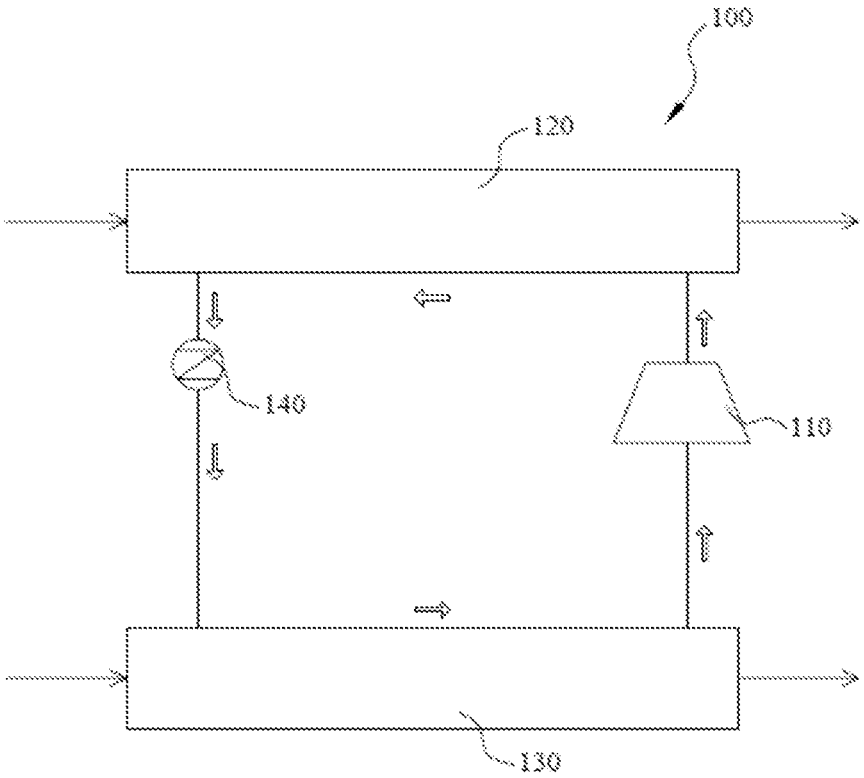
FIG. 1 is a schematic block diagram of refrigerating system 100.

FIG. 1 is a schematic block diagram of refrigerating system 100. As shown in FIG. 1, refrigerating system 100 comprises compressor 110, condenser 120, throttle device 140, and evaporator 130, which are connected by pipeline to form a refrigerant circulation loop, and a refrigerant is charged into the loop. As indicated by the arrow in FIG. 1, the refrigerant sequentially flows through compressor 110, condenser 120, throttle device 140, and evaporator 130, and then enters compressor 110 again. In the refrigerating process, a high-temperature high-pressure gaseous refrigerant discharged from compressor 110 performs heat exchange with an environmental medium in condenser 120, releases heat, and is condensed to a liquid refrigerant; throttle device 140 regulates the high-pressure liquid refrigerant from condenser 120, such that its pressure is reduced; the low-pressure refrigerant exchanges heat with an object to be cooled in evaporator 130, and is vaporized by absorbing the heat of the object to be cooled; and the refrigerant produced from vaporization is sucked into compressor 110, compressed, and then discharged at a high pressure, thereby forming a circulation.

Figure 2A:
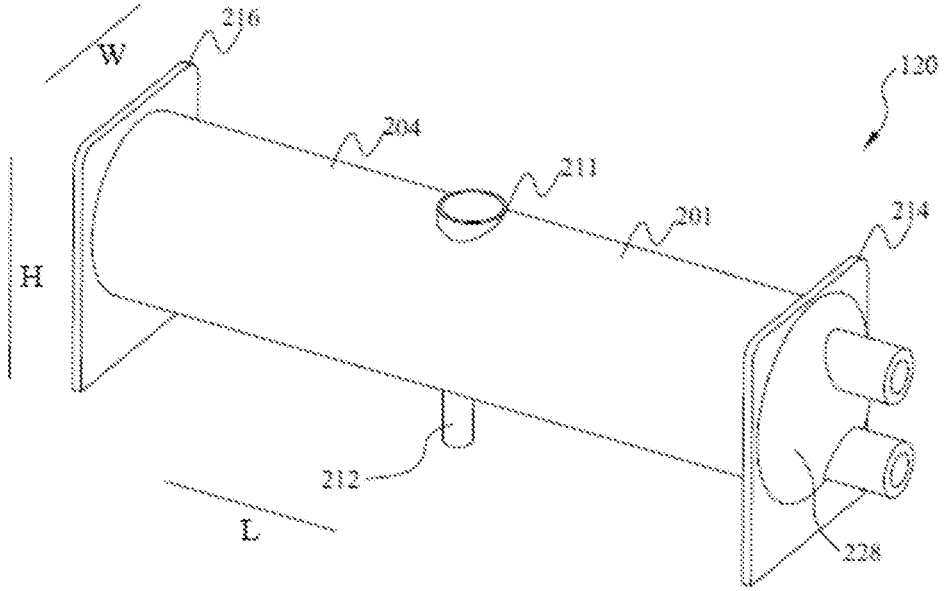
FIG. 2A is a 3D diagram of a first embodiment of condenser 120 in FIG. 1.
Figure 2B:
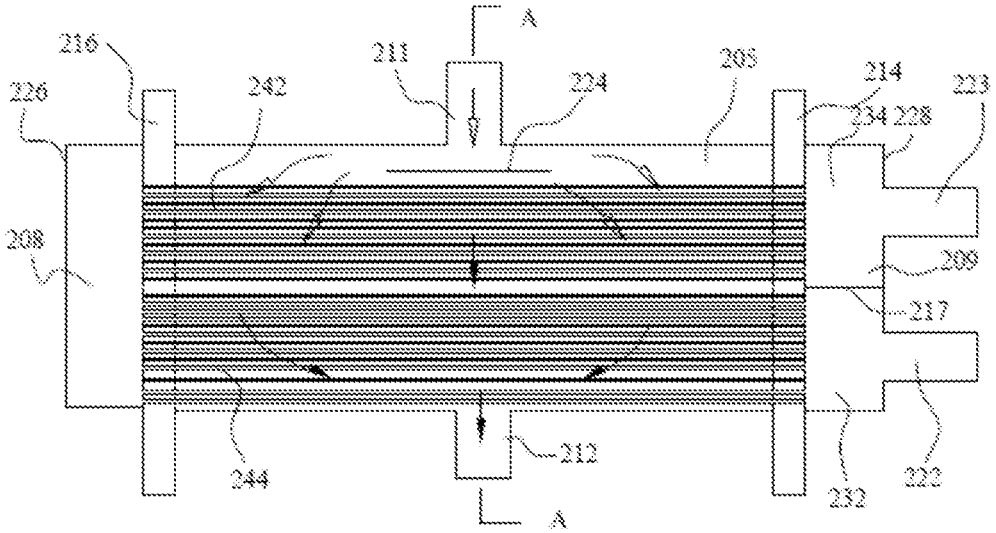
FIG. 2B is an axial cross-sectional view of condenser 120 in FIG. 2A.

FIG. 2A is a 3D diagram of a first embodiment of condenser 120 in FIG. 1, and FIG. 2B is an axial cross-sectional view of condenser 120 in FIG. 2A. Referring to the positions shown in FIG. 2A, condenser 120 has a height direction H, a length direction L, and a width direction W, and the height direction, the length direction, and the width direction of the cavity 205 are consistent with the directions of condenser 120. As shown in FIG. 2A and FIG. 2B, it is a condenser with a cooling medium in two processes, condenser 120 has housing 201, and housing 201 comprises cylinder body 204, left tube panel 216, right tube panel 214, rear water tank 226, and front water tank 228. Left and right ends of cylinder body 204 are respectively closed by left tube panel 216 and right tube panel 214 to form cavity 205. Rear water tank 226 is connected with left tube panel 216, and chamber 208 is formed between rear water tank 226 and left tube panel 216. Front water tank 228 is connected with right tube panel 214, and chamber 209 is formed between front water tank 228 and right tube panel 214. Horizontal partition panel 210 is provided in chamber 209 and extends horizontally from right tube panel 214 to front water tank 228, thereby forming that chamber 209 is partitioned into outlet cavity 234 and inlet cavity 232. Front water tank 228 is provided with medium inlet 222 and medium outlet 223 thereon, medium inlet 222 is in communication with inlet cavity 232, and medium outlet 223 is in communication with outlet cavity 234.

A heat exchange tube bundle formed by sequentially arranging a plurality of heat exchange tubes is provided in cavity 205. Each heat exchange tube in the heat exchange tube bundle extends along the length direction L of cavity 205. The heat exchange tube in condenser 120 comprises upper tube bundle 242 and lower tube bundle 244 disposed below upper tube bundle 242. Upper tube bundle 242 and lower tube bundle 244 are horizontally placed in cavity 205. One end of each heat exchange tube in upper tube bundle 242 is in fluid communication with chamber 208, and the other end thereof is in fluid communication with outlet cavity 234; one end of each heat exchange tube in lower tube bundle 244 is in fluid communication with chamber 208, and the other end thereof is in fluid communication with inlet cavity 232, such that the cooling medium can pass through medium inlet 222, then sequentially flow through inlet cavity 232, lower tube bundle 244, chamber 208, upper tube bundle 242, and outlet cavity 234, and then flow out condenser 120 through medium outlet 223. A fluid channel is formed inside each heat exchange tube in the heat exchange tube bundle for the cooling medium to circulate. The medium in the fluid channel exchanges heat with the refrigerant in the refrigerant channel by means of the tube wall of the heat exchange tubes. In other embodiments of the present application, the cooling medium may be set to a single process or multiple processes.

Refrigerant inlet 211 and refrigerant outlet 212 are provided on cylinder body 204, wherein refrigerant inlet 211 is disposed at an upper portion in the height direction of condenser 120, and refrigerant outlet 212 is disposed at a lower portion in the height direction of condenser 120. The gaseous refrigerant in refrigerating system 100 enters, from refrigerant inlet 211, the refrigerant channel between heat exchange tubes of condenser 120, exchanges heat with the cooling medium in the heat exchange tubes to become a liquid refrigerant, and is discharged from refrigerant outlet 212.

Condenser 120 further comprises impact panel 224. As an example, impact panel 224 is substantially a flat panel and extends along the length direction and the width direction of cavity 205. Impact panel 224 is arranged between refrigerant inlet 211 and upper tube bundle 242, and is at a certain distance from the inner wall of cylinder body 204 at refrigerant inlet 211. The area of impact panel 224 is greater than the area of refrigerant inlet 211. When the gaseous refrigerant enters cylinder body 204 through refrigerant inlet 211 at a high speed, impact panel 224 can prevent the gaseous refrigerant from directly impacting the heat exchange tubes. In addition, impact panel 224 can also guide the refrigerant to flow along the length direction and the width direction of cavity 205, enabling the refrigerant that enters cavity 205 through refrigerant inlet 211 to flow uniformly to the heat exchange tube bundle. Impact panel 224 is welded to cylinder body 102 through a connecting rod (not shown).

Figure 3A:
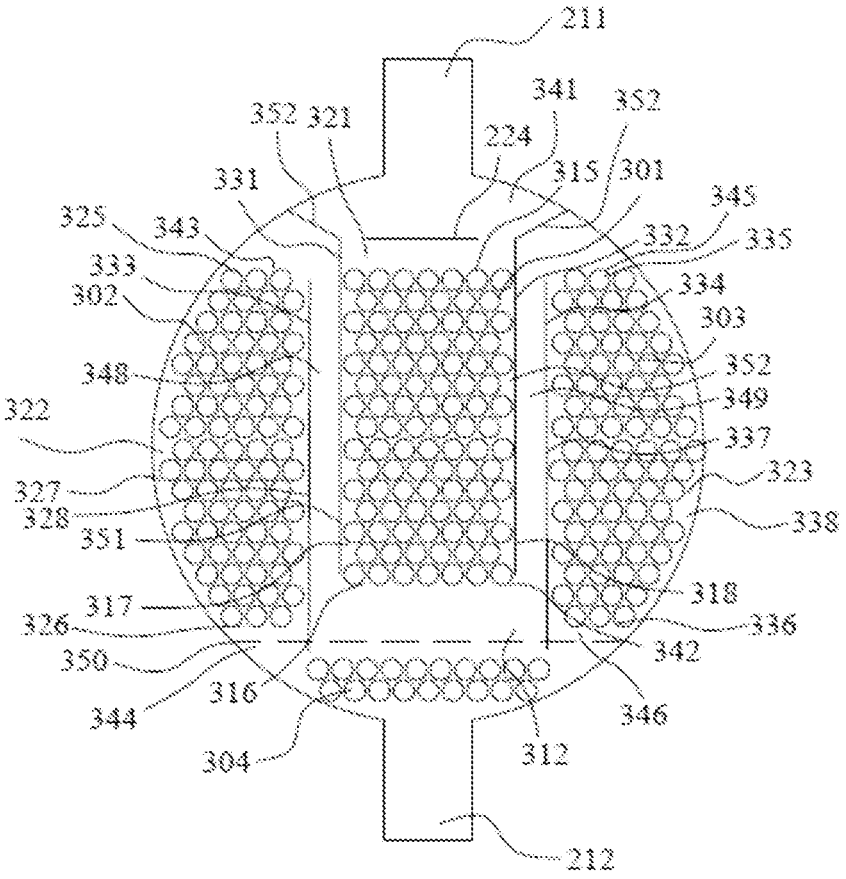
FIG. 3A is a radial cross-sectional view of condenser 120 along line A-A in FIG. 2.

FIG. 3A is a radial cross-sectional view of condenser 120 along line A-A in FIG. 2. As shown in FIG. 3A, the heat exchange tube bundle in cavity 205 is arranged along the width direction and the height direction of cavity 205. Condenser 120 comprises first heat exchange tube set 301, second heat exchange tube set 302, third heat exchange tube set 303, and bottom heat exchange tube set 304, wherein bottom heat exchange tube set 304 is disposed at the bottom of cavity 205 and arranged along the inner wall of the bottom of housing 201. First heat exchange tube set 301, second heat exchange tube set 302, and third heat exchange tube set 303 are all arranged along the height direction and the width direction of cavity 205. In the height direction of cavity 205, first heat exchange tube set 301, second heat exchange tube set 302, and third heat exchange tube set 303 are all disposed above bottom heat exchange tube set 304. In the width direction of cavity 205, second heat exchange tube set 302 and third heat exchange tube set 303 are respectively disposed at two sides of first heat exchange tube set 301. In the width direction of cavity 205, refrigerant inlet 211 is aligned with at least one part of first heat exchange tube set 301, and is respectively staggered with second heat exchange tube set 302 and third heat exchange tube set 303. Respective heights of first heat exchange tube set 301, second heat exchange tube set 302, and third heat exchange tube set 303 are not smaller than the radius of cavity 205.

First heat exchange tube set 301 has top 315, bottom 316, left side 317, and right side 318, wherein first heat exchange tube set 301 is disposed below impact panel 224, and there is a certain distance between top 315 of first heat exchange tube set 301 and impact panel 224 to facilitate the refrigerant after being guided by impact panel 224 to flow along the length direction of cavity 205, such that top 315 of first heat exchange tube set 301 can uniformly receive the refrigerant. There is a certain distance between bottom 316 of first heat exchange tube set 301 and bottom heat exchange tube set 304. Second heat exchange tube set 302 is disposed at the left side of first heat exchange tube set 301, and second heat exchange tube set 302 has top 325, bottom 326, left side 327, and right side 328. Bottom 326 of second heat exchange tube set 302 is higher than bottom heat exchange tube set 324, left side 327 of second heat exchange tube set 302 is arranged to be adjacent to the inner wall of housing 201, and there is a certain distance between right side 328 of second heat exchange tube set 302 and left side 317 of first heat exchange tube set 301. Third heat exchange tube set 303 is disposed at the right side of first heat exchange tube set 301, and third heat exchange tube set 303 has top 335, bottom 336, left side 337, and right side 338. Bottom 336 of third heat exchange tube set 303 is higher than bottom heat exchange tube set 304, right side 338 of third heat exchange tube set 303 is arranged to be adjacent to the inner wall of housing 201, and there is a certain distance between left side 327 of third heat exchange tube set 303 and right side 318 of first heat exchange tube set 301.

During operations of condenser 120, the liquid refrigerant at the bottom of condenser 120 maintains a certain liquid level, as shown by dashed line 350. Bottom heat exchange tube set 304 is immersed in the liquid refrigerant, thereby performing supercooling on the liquid refrigerant. Bottom 316 of first heat exchange tube set 301 is higher than the level of the liquid refrigerant, such that horizontal fluid channel 312 is formed between bottom 316 of first heat exchange tube set 301 and the level plane of the liquid refrigerant, and horizontal fluid channel 312 can allow the gaseous refrigerant to pass through.

Condenser 120 comprises a pair of first baffles 331 and 332. In the width direction of cavity 205, first baffle 331 is adjacent to left side 317 of the first heat exchange tube set with a small spacing from left side 317, and first baffle 332 is adjacent to right side 318 of first heat exchange tube set 301 with a small spacing from right side 318. A top end of first baffle 331 is connected to housing 201, a bottom end of first baffle 331 is flush with the bottom of first heat exchange tube set 301, first baffle 331 extends along the length direction, and two ends thereof in the length direction are respectively connected to left tube panel 216 and right tube panel 214. A top end of first baffle 332 is connected to housing 201, a bottom end of first baffle 332 is flush with the bottom of first heat exchange tube set 301, first baffle 332 extends along the length direction, and two ends thereof in the length direction are respectively connected to left tube panel 216 and right tube panel 214. The connections of the top end of first baffle 331 and the top end of first baffle 332 with housing 201 are respectively located at two sides of refrigerant inlet 211.

First baffle 331, first baffle 332, left tube panel 216, and right tube panel 214 enclose to form first accommodating space 321, and first heat exchange tube set 301 is arranged in first accommodating space 321. First accommodating space 321 has first accommodating space inlet 341 disposed at the upper portion of first heat exchange tube set 301 and first accommodating space outlet 342 disposed at the lower portion of first heat exchange tube set 301, wherein first accommodating space inlet 341 is in communication with refrigerant inlet 211, and first accommodating space outlet 342 is in communication with horizontal fluid channel 312. Top 315 of first heat exchange tube set 301 is lower than first accommodating space inlet 341. In one embodiment of the present application, impact panel 224 may also be disposed in first accommodating space 321 and lower than first accommodating space inlet 341. In other embodiment of the present application, impact panel 224 may be disposed above first accommodating space 321.

First baffle 331 and first baffle 332 each comprise main body section 351 and guide section 352, main body section 351 extends in the height direction of cavity 205, the bottom of main body section 351 is flush with first heat exchange tube set 301, and the top of main body section 351 exceeds the top of first heat exchange tube set 301 or is flush with the top of first heat exchange tube set 301. The guide section extends upwardly from the top of main body section 351 and toward a direction away from first heat exchange tube set 301 until being connected with housing 201, such that guide section 352 is disposed above first vertical fluid channel 348 or second vertical fluid channel 349. The direction of guide section 352 is set to facilitate guiding the fluid in first vertical fluid channel 348 and second vertical fluid channel 349 to smoothly flow to second accommodating space 322 and third accommodating space 323. At the same time, guide section 352 causes the upper portion of first accommodating space 321 to be of a reducing truncated cone, which favors guiding the gaseous refrigerant to the top of first heat exchange tube set 301.

The condenser further comprises second baffle 333 and third baffle 334. Second baffle 333 is adjacent to right side 328 of second heat exchange tube set 302 with a small spacing from right side 328. Second baffle 333 extends in the length direction of cavity 205, and two ends thereof in the length direction are respectively connected to left tube panel 216 and right tube panel 214. Second baffle 333, housing 201, left tube panel 216, and right tube panel 214 enclose to form second accommodating space 322, and second heat exchange tube set 302 is arranged in second accommodating space 322. Second accommodating space 322 has second accommodating space inlet 343 disposed at the upper portion thereof and second accommodating space outlet 344 disposed at the lower portion thereof. There is a spacing between second baffle 333 and first baffle 331, thereby forming first vertical fluid channel 348. The top end of first vertical fluid channel 348 is in communication with second accommodating space inlet 343, and the bottom end of first vertical fluid channel 348 is in communication with horizontal fluid channel 312.

Similarly, third baffle 334 is adjacent to left side 337 of third heat exchange tube set 303 with a small spacing from left side 337. Third baffle 334 extends in the length direction of cavity 205, and two ends thereof in the length direction are respectively connected to left tube panel 216 and right tube panel 214. Third baffle 334, housing 201, left tube panel 216, and right tube panel 214 enclose to form third accommodating space 323, and third heat exchange tube set 303 is arranged in third accommodating space 323. Third accommodating space 323 has third accommodating space inlet 345 disposed at the upper portion thereof and third accommodating space outlet 346 disposed at the lower portion thereof. There is a spacing between third baffle 334 and first baffle 332, thereby forming second vertical fluid channel 349. The top end of second vertical fluid channel 349 is in communication with third accommodating space inlet 345, and the bottom end of second vertical fluid channel 349 is in communication with horizontal fluid channel 312.

In the height direction of cavity 205, second baffle 333 and third baffle 334 respectively extend to exceed first baffle 331 and first baffle 332. During operations of condenser 120, the bottom end of second baffle 333 and the bottom end of third baffle 334 are at least partially immersed in the liquid refrigerant. In other words, the bottom of second baffle 333 and the bottom of third baffle 334 are below the level plane of the liquid refrigerant, such that the lower portion of second baffle 333 and the lower portion of third baffle 334 close horizontal fluid channel 312 in the height direction of cavity 205.

Figure 3B:
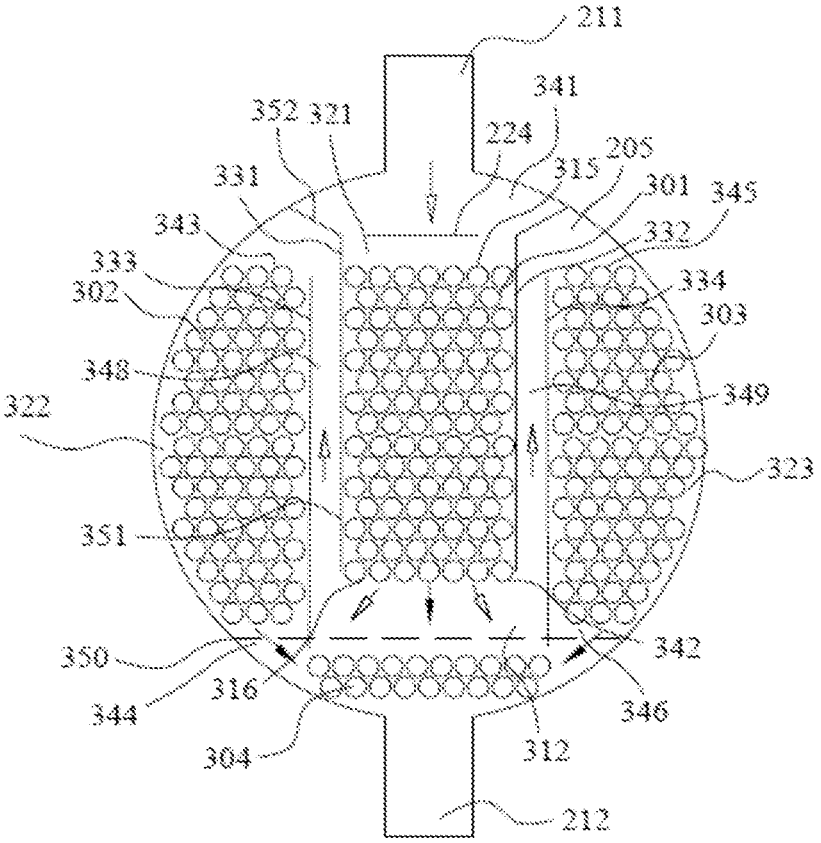
FIG. 3B is a schematic diagram of a flow direction of a refrigerant of condenser 120 in FIG. 3A.

FIG. 3B is a schematic diagram of a flow direction of a refrigerant of condenser 120 in FIG. 3A. As shown in FIG. 3B, the gaseous refrigerant from the refrigerant circulation loop enters condenser 120 via refrigerant inlet 211. Since respective tops of first baffle 331 and first baffle 332 are connected with the housing, and respective two ends of first baffle 331 and first baffle 332 in the length direction are connected to left tube panel 216 and right tube panel 214, the gaseous refrigerant entering the condenser via refrigerant inlet 211 enters first accommodating space 321 via first accommodating space inlet 341. The gaseous refrigerant that has entered first accommodating space 321 is guided by impact panel 224 and collected and guided by respective guide sections 352 of first baffle 331 and first baffle 332, and then uniformly flows to top 315 of first heat exchange tube set 301. First baffle 331 and first baffle 332 block the gaseous refrigerant from flowing in a direction toward second heat exchange tube set 302 and third heat exchange tube set 303. As a result, the gaseous refrigerant flows, from top to bottom, in the space between heat exchange tubes of first heat exchange tube set 301, and exchanges heat with the medium in the heat exchange tubes of first heat exchange tube set 301. In the process of heat exchange between the gaseous refrigerant and first heat exchange tube set 301, a part of the gaseous refrigerant is condensed into a liquid refrigerant, and the other part thereof remains to be gaseous. The liquid refrigerant flows downwardly and flows through horizontal fluid channel 312 until it is integrated into the liquid refrigerant deposited on the bottom of condenser 120, and the gaseous refrigerant leaves first heat exchange tube set 301 and enters horizontal fluid channel 312. Since two ends of horizontal fluid channel 312 are respectively in communication with first vertical fluid channel 348 and second vertical fluid channel 349, the gaseous refrigerant flows upwardly along first vertical fluid channel 348 and second vertical fluid channel 349, and is guided by guide sections 352 of first baffle 331 and first baffle 332 to respectively enter second accommodating space inlet 343 and third accommodating space inlet 345. The gaseous refrigerant continues heat exchange in second heat exchange tube set 302 and third heat exchange tube set 303, respectively, and is converted into a liquid refrigerant, which flows out from second accommodating space outlet 344 and third accommodating space outlet 346, and is integrated into the liquid refrigerant deposited on the bottom of condenser 120. The liquid refrigerant condensed by condenser 120 flows out of refrigerant outlet 212 and enters the refrigerant circulation loop.

In the embodiments shown in the present application, after flowing through first heat exchange tube set 301 for heat exchange in condenser 120, the gaseous refrigerant then performs heat exchange by flowing through second heat exchange tube set 302 and third heat exchange tube set 303. Since first baffles 331 and 332, second baffle 333, and third baffle 334 partition the interior space of condenser 120, the flow cross-sectional area in the flow direction of the gaseous refrigerant is reduced compared with conventional condensers, thereby improving the flow rate of the gaseous refrigerant, which favors the improvement of the heat exchange efficiency of the condenser.

Figure 4:
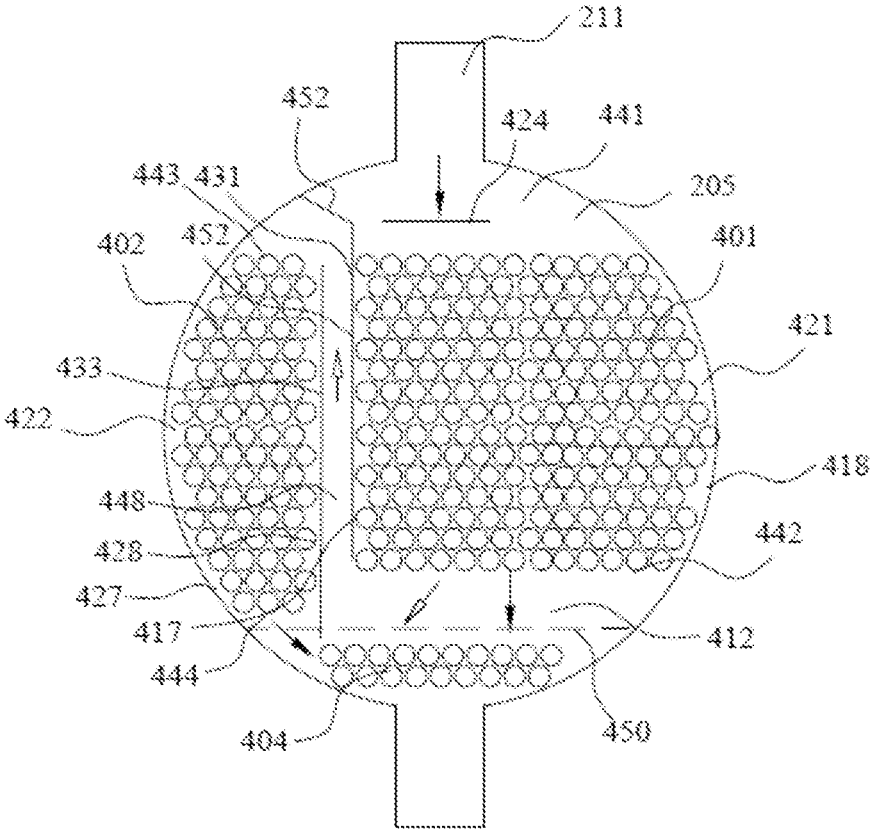
FIG. 4 is a radial cross-sectional view of a second embodiment of the condenser in the present application.

FIG. 4 is a radial cross-sectional view of a second embodiment of the condenser in the present application, which is similar to the embodiment shown in FIG. 3A. The difference is that the embodiment shown in FIG. 4 only comprises one vertical fluid channel. As shown in FIG. 4, the condenser comprises first heat exchange tube set 401, second heat exchange tube set 402, and bottom heat exchange tube set 404, as well as first baffle 431 and second baffle 433.

First heat exchange tube set 401 and second heat exchange tube set 402 are both arranged in the height direction and the width direction of the cavity 205. In the height direction of the cavity 205, first heat exchange tube set 401 and second heat exchange tube set 402 are both above bottom heat exchange tube set 404. In the width direction of the cavity 205, second heat exchange tube set 402 is located at one side of first heat exchange tube set 401. Refrigerant inlet 211 is aligned with at least one part of first heat exchange tube set 401 and staggered with second heat exchange tube set 402 in the width direction.

During operations of the condenser, the liquid refrigerant at the bottom of the condenser maintains a certain liquid level, as shown by dashed line 450. Bottom heat exchange tube set 404 is immersed in the liquid refrigerant, thereby performing supercooling on the liquid refrigerant. The bottom of first heat exchange tube set 401 is higher than the level of the liquid refrigerant, such that horizontal fluid channel 412 is formed between first heat exchange tube set 401 and the level plane of the liquid refrigerant, and the horizontal fluid channel can allow the gaseous refrigerant to pass through.

First heat exchange tube set 401 has left side 417 and right side 418, and right side 418 is adjacent to the inner wall of housing 201. Second heat exchange tube set 402 has left side 427 and right side 428, left side 427 is adjacent to the inner wall of housing 201. Second heat exchange tube set 402, and there is a spacing between right side 428 and first heat exchange tube set 401. First baffle 431 is adjacent to left side 417 of first heat exchange tube set 401, and second baffle 433 is adjacent to right side 428 of second heat exchange tube set 402, such that vertical fluid channel 448 is formed between first baffle 431 and second baffle 432, and vertical fluid channel 448 is in communication with horizontal fluid channel 412.

A top end of first baffle 431 is connected to the housing, a bottom end of first baffle 431 is flush with the bottom of first heat exchange tube set 401, two ends of first baffle 431 in the length direction of cavity 205 are respectively connected to left tube panel 216 and right tube panel 214, and first baffle 431, housing 201, and inner walls of left tube panel 216 and right tube panel 214 enclose to form first accommodating space 421, and first heat exchange tube set 401 is disposed in first accommodating space 421. First accommodating space 421 has first accommodating space inlet 441 and first accommodating space outlet 442, first accommodating space inlet 441 is in communication with refrigerant inlet 211, and first accommodating space outlet 442 is in communication with horizontal fluid channel 412.

Second accommodating space 422 is formed between second baffle 433 and housing 201, second heat exchange tube set 402 is arranged in second accommodating space 422, and second accommodating space 422 has second accommodating space inlet 443 and second accommodating space outlet 444. Second accommodating space inlet 443 is in communication with vertical fluid channel 438, and second accommodating space outlet 444 is disposed below the refrigerant level plane when the condenser is working.

First baffle 431 comprises main body section 451 and guide section 452, main body section 451 extends in the height direction of cavity 205, the bottom of main body section 451 is flush with the first heat exchange tube set, and the top of main body section 451 exceeds the top of first heat exchange tube set 401 or is flush with the top of first heat exchange tube set 401. Guide section 452 extends upwardly from the top of main body section 451 and toward a direction away from first heat exchange tube set 401 until being connected with housing 201, such that guide section 452 is disposed above vertical fluid channel 438. The direction of guide section 452 is set to facilitate guiding the fluid in vertical fluid channel 438 to smoothly flow to second accommodating space 422.

In the height direction of cavity 205, second baffle 433 extends downwardly to exceed first baffle 431. During operations of condenser 120, the bottom end of second baffle 433 is at least partially immersed in the liquid refrigerant. In other words, the bottom of second baffle 333 is below the level plane of the liquid refrigerant, such that the lower portion of second baffle 433 closes horizontal fluid channel 412 in the height direction of cavity 205.

The gaseous refrigerant from the refrigerant circulation loop enters condenser 120 via refrigerant inlet 211. The gaseous refrigerant entering the condenser via refrigerant inlet 211 enters first accommodating space 421 via first accommodating space inlet 441. The gaseous refrigerant that has entered first accommodating space 421 is guided by impact panel 424 and collected and guided by guide section 452 of first baffle 431, and then uniformly flows to the top of first heat exchange tube set 401. First baffle 431 blocks the gaseous refrigerant from flowing in a direction toward second heat exchange tube set 402. As a result, the gaseous refrigerant flows, from top to bottom, in the space between heat exchange tubes of first heat exchange tube set 401, and exchanges heat with the medium in the heat exchange tubes of first heat exchange tube set 401. In the process of heat exchange between the gaseous refrigerant and first heat exchange tube set 401, a part of the gaseous refrigerant is condensed into a liquid refrigerant, and the other part of the refrigerant remains to be gaseous. The liquid refrigerant flows downwardly and flows through horizontal fluid channel 412 until it is integrated into the liquid refrigerant deposited on the bottom of the condenser, and the gaseous refrigerant leaves first heat exchange tube set 401 and enters horizontal fluid channel 412. Since one end of horizontal fluid channel 412 is in communication with vertical fluid channel 448, the gaseous refrigerant flows upwardly along vertical fluid channel 448, and is guided by guide section 352 of first baffle 431 to enter second accommodating space inlet 443. The gaseous refrigerant exchanges heat in second heat exchange tube set 402 with the medium in the heat exchange tubes of second heat exchange tube set 402, and is converted into a liquid refrigerant, which flows out from second accommodating space outlet 445, and is integrated into the liquid refrigerant deposited on the bottom of condenser 120. The liquid refrigerant condensed by condenser 120 flows out of refrigerant outlet 212 and enters the refrigerant circulation loop. The embodiment shown in FIG. 4 also can improve the heat exchange efficiency of the condenser.

Figure 5:
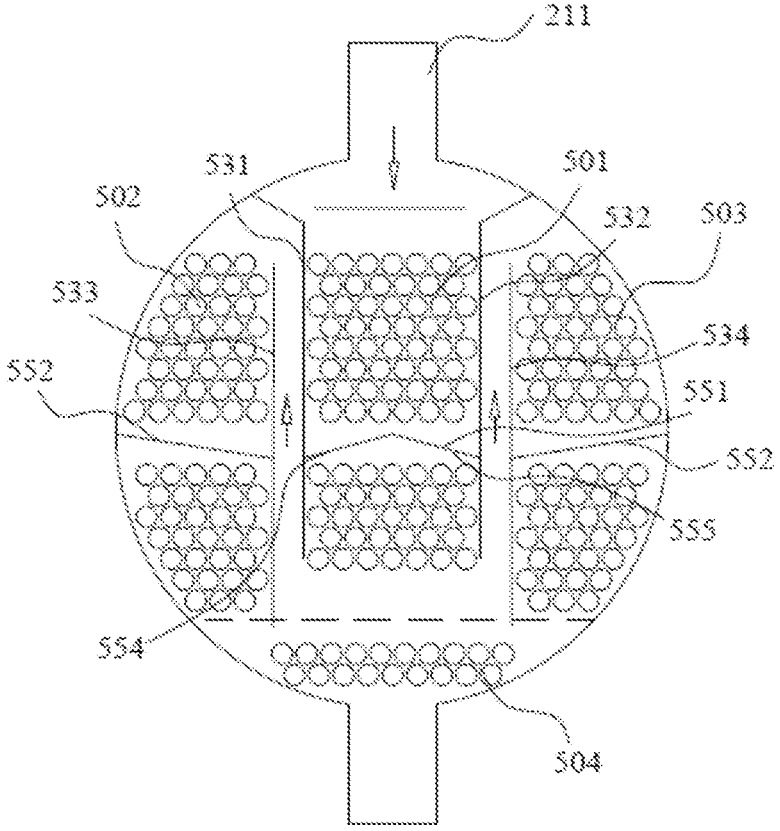
FIG. 5 is a radial cross-sectional view of a third embodiment of the condenser in the present application.

FIG. 5 is a radial cross-sectional view of a third embodiment of the condenser in the present application, which is similar to the embodiment shown in FIG. 3A. The difference is that the embodiment shown in FIG. 5 further comprises middle guide plates. As shown in FIG. 5, the condenser comprises first heat exchange tube set 501, second heat exchange tube set 502, third heat exchange tube set 503, and bottom heat exchange tube set 504, as well as first baffles 531 and 532, second baffle 533, and third baffle 534. Middle guide plates 551 and 552 are provided in first heat exchange tube set 501, second heat exchange tube set 502, and third heat exchange tube set 503. Middle guide plates 551 and 552 extend in the length direction of cavity 205, and respective two ends thereof in the length direction are respectively connected to left tube panel 216 and right tube panel 214. Middle guide plate 551 comprises first inclined section 554 and second inclined section 555, first inclined section 554 has a small spacing from first baffle 531 and extends in a tilted manner upwardly from first baffle 531, and the second inclined section has a small spacing from first baffle 532 and extends in a tilted manner upwardly from first baffle 532 until being connected with first inclined section 554, such that middle guide plate 551 is of an inverted V shape on the radial cross-section of the condenser. Vent holes are formed on middle guide plate 551 and are long strips extending along the inclined direction, and the vent holes allow a gaseous refrigerant to pass through. Middle guide plate 551 can guide a part of the liquid refrigerant produced by the heat exchange tubes above middle guide plate 551 to flow along first baffles 531 and 532, instead of directly dripping on the heat exchange tubes below middle guide plate 551, so as to reduce the liquid film produced on the outer wall of the heat exchange tubes below middle guide plate 551, thereby improving the heat exchange efficiency. At the same time, the vent holes on middle guide plate 551 can allow a gaseous refrigerant to pass through to continue heat exchange with the heat exchange tubes below middle guide plate 551.

Similarly, middle guide plate 552 disposed in second heat exchange tube set 502 or third heat exchange tube set 503 has a certain spacing from second baffle 533 or third baffle 534, and extends in a tilted manner upwardly from second baffle 533 or third baffle 534, so as to guide the liquid refrigerant to flow along second baffle 533 or third baffle 534, while the gaseous refrigerant flows through the vent holes of middle guide plate 552 to continue heat exchange with the heat exchange tubes below middle guide plate 552. For middle guide plate 552, the whole piece of middle guide plate 552 is an inclined section. In other embodiments of the present application, middle guide plate 552 may also have a small spacing from housing 201 and extends in a tilted manner upwardly from housing 201, so as to guide the liquid refrigerant to flow along the housing. Second heat exchange tube set 502 or third heat exchange tube set 503 may also be provided with a middle guide plate of an inverted V shape.

The embodiment shown in FIG. 5 is built on the embodiment shown in FIG. 3A. The middle guide plate performs flow division, to a certain extent, on the refrigerant at the middle of comprises first heat exchange tube set 501, second heat exchange tube set 502, or third heat exchange tube set 503 to guide a part of the liquid refrigerant to flow along first baffles 531 and 532, second baffle 533, third baffle 534, or housing 201, which reduces the impact of the liquid refrigerant on the heat exchange tubes below the middle guide plate and can improve the heat exchange efficiency of the heat exchange tubes below the guide plate, thereby improving the heat exchange efficiency of the condenser.

Figure 6:
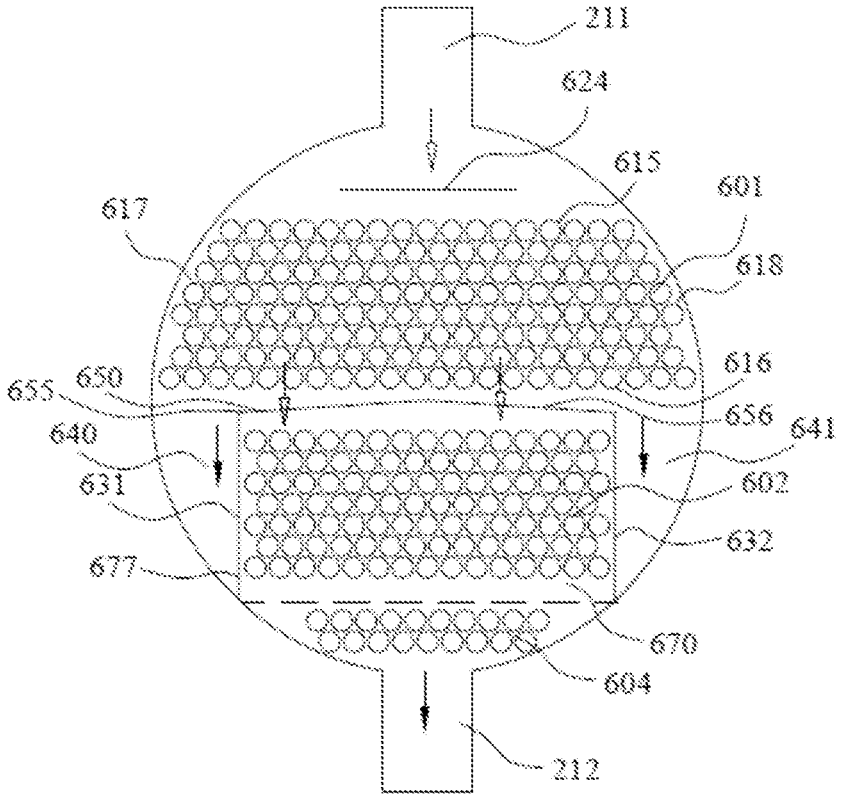
FIG. 6 is a radial cross-sectional view of a fourth embodiment of the condenser in the present application.

FIG. 6 is a radial cross-sectional view of a fourth embodiment of the condenser in the present application. As shown in FIG. 6, the condenser comprises first heat exchange tube set 601, second heat exchange tube set 602, and bottom heat exchange tube set 604. In the height direction of cavity 205, first heat exchange tube set 601 is disposed above second heat exchange tube set 602, and second heat exchange tube set 602 is disposed above bottom heat exchange tube set 604. First heat exchange tube set 601 has top 615, bottom 616, left side 617, and right side 618. Left side 617 and right side 618 are respectively adjacent to housing 201. Second heat exchange tube set 602 has top 625, bottom 626, left side 627, and right side 628. Left side 627 of second heat exchange tube set 602 has a certain spacing from housing 201, and right side 628 of second heat exchange tube set 602 also has a certain spacing from housing 201.

The condenser further comprises first baffle 631, second baffle 632, and guide plate 650, wherein first baffle 631 is arranged to be adjacent to left side 627 of second heat exchange tube set 602, two ends of first baffle 631 in the length direction of cavity 205 are respectively connected to left tube panel 216 and right tube panel 214, first baffle 631 extends along the vertical direction, its top is not lower than the height of second heat exchange tube set 602, and its bottom is connected to housing 201. Two ends of second baffle 632 in the length direction of cavity 205 are respectively connected to left tube panel 216 and right tube panel 214, second baffle 632 extends along the vertical direction, its top is not lower than the height of second heat exchange tube set 602, and its bottom is connected to housing 201. Two ends of guide plate 650 in the length direction of cavity 205 are respectively connected to left tube panel 216 and right tube panel 214. Two ends of guide plate 650 in the width direction of cavity 205 are respectively connected to tops of first baffle 631 and second baffle 632. Bottom heat exchange space 670 is formed between first baffle 631, second baffle 632, guide plate 650, and the housing, and second heat exchange tube set 602 and bottom heat exchange tube set 604 are both disposed in bottom heat exchange space 670.

There is a certain spacing between first baffle 631 and housing 201, thereby forming fluid space 640, and there is a certain spacing between second baffle 632 and housing 201, thereby forming fluid space 641. Openings are formed on the bottom of first baffle 631 and second baffle 632 to form a connection channel, such that bottom heat exchange space 670 can be in communication with fluid space 640 and fluid space 641. In other embodiments of the present application, the connection channel may also be formed by the space between the bottoms of first baffle 631 and second baffle 632 and housing 201. Guide plate 650 is gradually lowered from the middle to two sides, thereby forming first inclined section 655 and second inclined section 656, and first inclined section 655 and second inclined section 656 guide the liquid refrigerant to flow to fluid space 640 and fluid space 641. Long strip-shaped vent holes are formed on first inclined section 655 and second inclined section 656 and extend along respective inclined directions, so as to allow the gaseous refrigerant to pass through.

In the embodiment shown in FIG. 6, the gaseous refrigerant enters the condenser via refrigerant inlet 211 and is then guided by impact panel 624 to uniformly flow to top 615 of first heat exchange tube set 601. The refrigerant flows, from top to bottom, in first heat exchange tube set 601, and exchanges heat with the heat exchange tubes of first heat exchange tube set 601, a part of the gaseous refrigerant is converted to a liquid refrigerant, and the other part of the refrigerant still remains to be gaseous. Most of the liquid refrigerant is guided by guide plate 650 to flow to fluid space 640 and fluid space 641, and then flows to bottom heat exchange tube set 604 via the fluid channels at the lower portions of first baffle 631 and second baffle 632; the gaseous refrigerant and a small amount of the liquid refrigerant enter, via the vent holes on guide plate 650, second heat exchange tube set 602 for heat exchange and are converted to a liquid refrigerant that flows to bottom heat exchange tube set 604. The liquid refrigerant that flows is cooled by bottom heat exchange tube set 604 and then flows out of the refrigerant outlet.

In the embodiment shown in FIG. 6, in the flow direction of the refrigerant that is from top to bottom, the flow cross-sectional area of the bottom heat exchange space is smaller than the flow cross-sectional area of the bottom 616 of first heat exchange tube set 601, such that the flow rate of the gaseous refrigerant in second heat exchange tube set 602 is increased, which favors changing the flow pattern of the gaseous refrigerant in second heat exchange tube set 602, and improves the heat exchange efficiency of second heat exchange tube set 602. At the same time, guide plate 650 guides a part of the liquid refrigerant produced by first heat exchange tube set 601 into fluid space 640 and fluid space 641, to prevent this part of the liquid refrigerant from entering second heat exchange tube set 602 to affect the heat exchange efficiency of second heat exchange tube set 602.

In another embodiment of the present application, it is also possible to only provide first baffle 631 and second baffle 632 without guide plate 650. In this way, the flow rate of the gaseous refrigerant in second heat exchange tube set 602 can also be increased to a certain extent, thereby achieving the goal of improving the heat exchange efficiency of second heat exchange tube set 602.

The condenser involved in the present application is a shell and tube condenser, where a refrigerant flows between heat exchange tubes, and a cooling medium flows within the heat exchange tubes. Typically, in a conventional shell and tube condenser, the flow rate of the refrigerant at the lower portion of the condenser decreases as the gaseous refrigerant is continuously condensed into a liquid, and it is not easy for the gaseous refrigerant to diffuse to heat exchange tubes in the middle and at the bottom of the condenser. The heat exchange efficiency of heat exchange tubes in the middle and at the bottom is low.

Moreover, in a conventional condenser, heat exchange tubes are arranged in rows in the condenser, the refrigerant inlet is arranged above the condenser, and the refrigerant outlet is arranged below the condenser. The refrigerant flows from top to bottom. During the flowing process, the gaseous refrigerant is continuously condensed into a liquid refrigerant, and heat exchange tubes at the lower portion are affected by the liquid refrigerant produced from condensation. As a result, the liquid film on the heat exchange tubes at the lower portion becomes thicker, and the heat exchange coefficient will decrease. The heat exchange coefficient of a heat exchange tubes may be expressed using the following equation:

$$\frac{\alpha_N}{\alpha_1} = N^{-1/6}$$

where $\alpha_N$ is a condensation heat exchange coefficient of tubes in the N-th row, and $\alpha_1$ is a condensation heat exchange coefficient of tubes in the first row.

In the present application, by providing the baffles, the flow rate of the gaseous refrigerant in the condenser is increased, which facilitates the breakthrough of a liquid film on heat exchange tubes, and makes it easy for the gaseous refrigerant to diffuse to heat exchange tubes in the middle and at the bottom of the condenser, thereby improving the condensation and heat exchange efficiency.

In some embodiments of the present application, the condenser further comprises a guide plate, which can promptly discharge the condensate, such that the liquid film on heat exchange tubes at the lower portion becomes thinner, and the heat exchange efficiency is improved; moreover, it can re-allocate the gaseous refrigerant and change the flow pattern of the gaseous refrigerant, thereby improving the heat exchange effect. The guide and re-allocation by the guide plate can improve the heat exchange coefficient of heat exchange tubes below the guide plate. The heat exchange coefficient of heat exchange tubes in the first row below the guide plate reaches or is higher than the heat exchange coefficient of heat exchange tubes in the first row of existing condensers.

Only some features of the present application are illustrated and described herein, and a variety of improvements and variations may be made by those skilled in the art. Therefore, it should be understood that the appended claims intend to encompass all the above improvements and variations that fall within the scope of the essential spirit of the present application.

The invention claimed is:

1. A condenser, comprising:

a housing, wherein the housing comprises a cavity, the cavity has a length direction, a width direction, and a height direction, and a refrigerant inlet and a refrigerant outlet are provided on the housing;

a first heat exchange tube set, a second heat exchange tube set, and a third heat exchange tube set, wherein the second heat exchange tube set and the third heat exchange tube set are arranged, in the width direction of the cavity, at opposite sides of the first heat exchange tube set, and a horizontal fluid channel is provided below the first heat exchange tube set;

a pair of first baffles, wherein each first baffle of the pair of first baffles is, in the width direction of the cavity, respectively adjacent to the opposite sides of the first heat exchange tube set, a top end of each first baffle of the pair of first baffles extends above the first heat exchange tube set and is connected with the housing, and a bottom end of each first baffle of the pair of first baffles extends to a bottom end of the first heat exchange tube set;

a second baffle, wherein the second baffle is, in the width direction of the cavity, adjacent to one side of the second heat exchange tube set that is close to the first heat exchange tube set, a first vertical fluid channel is formed between the second baffle and one first baffle of the pair of first baffles that is close to the second heat exchange tube set, and the first vertical fluid channel is in communication with the horizontal fluid channel; and a third baffle, wherein the third baffle is, in the width direction of the cavity, adjacent to one side of the third heat exchange tube set that is close to the first heat exchange tube set, a second vertical fluid channel is formed between the third baffle and one first baffle of the pair of first baffles that is close to the third heat exchange tube set, and the second vertical fluid channel is in communication with the horizontal fluid channel, wherein the pair of first baffles is configured to cause the first heat exchange tube set to receive refrigerant from the refrigerant inlet, and the pair of first baffles, the second baffle, and the third baffle are configured to direct refrigerant from the first heat exchange tube set to the second heat exchange tube set and the third heat exchange tube set via the horizontal fluid channel, the first vertical fluid channel, and the second vertical fluid channel.

2. The condenser of claim 1, wherein, during operation of the condenser, a lower portion of the second baffle and a lower portion of the third baffle are at least partially immersed in liquid refrigerant.

3. The condenser of claim 1, wherein:

a first accommodating space is formed between the pair of first baffles, the first heat exchange tube set is arranged in the first accommodating space, the first accommodating space has a first accommodating space inlet and a first accommodating space outlet, the first accommodating space inlet is in communication with the refrigerant inlet, and the first accommodating space outlet is in communication with the horizontal fluid channel.

4. The condenser of claim 1, wherein:

a second accommodating space is formed between the second baffle and the housing, the second heat exchange tube set is arranged in the second accommodating space, the second accommodating space has a second accommodating space inlet, and the second accommodating space inlet is in communication with the first vertical fluid channel, and a third accommodating space is formed between the third baffle and the housing, the third heat exchange tube set is arranged in the third accommodating space, the third accommodating space has a third channel inlet, and the second accommodating space inlet is in communication with the second vertical fluid channel.

5. The condenser of claim 1, wherein:

each first baffle of the pair of first baffles comprises a main body section and a guide section, the main body section extends in the height direction of the cavity, a top of the main body section is flush with a top of the first heat exchange tube set or exceeds the top of the first heat exchange tube set, the guide section extends upwardly from the top of the main body section and tilts toward a direction away from the first heat exchange tube set until being connected with the housing, and the guide section is disposed above the first vertical fluid channel or the second vertical fluid channel.

6. The condenser of claim 1, further comprising:

middle guide plates, wherein vent holes are formed on the middle guide plates to allow a gas to flow through, the middle guide plates are arranged inside the first heat exchange tube set, the second heat exchange tube set, or the third heat exchange tube set, the middle guide plates comprise an inclined section, and the inclined section extends in a tilted manner upwardly from at least one of the pair of first baffles, the second baffle, the third baffle, or the housing, so as to guide liquid refrigerant to flow along one of the pair of first baffles, the second baffle, the third baffle, or the housing.

7. The condenser of claim 6, wherein:

the vent holes are long strips extending along an inclined direction of the inclined section.

8. A condenser, comprising:

a housing, wherein the housing comprises a cavity, the cavity has a length direction, a width direction, and a height direction, and a refrigerant inlet and a refrigerant outlet are provided on the housing;

a first heat exchange tube set and a second heat exchange tube set, wherein the first heat exchange tube set is arranged at one side of the second heat exchange tube set, and a horizontal fluid channel is provided below the first heat exchange tube set; and a first baffle and a second baffle, wherein the first baffle is adjacent to the first heat exchange tube set, the second baffle is adjacent to the second heat exchange tube set, a vertical fluid channel is formed between the first baffle and the second baffle, the vertical fluid channel is in communication with the horizontal fluid channel, a top end of the first baffle extends to above the first heat exchange tube set and is connected with the housing, a bottom end of the first baffle extends to a bottom end of the first heat exchange tube set, a top end of the second baffle extends to a top end of the second heat exchange tube set, and the second baffle extends downwardly so that a bottom end of the second baffle closes the horizontal fluid channel in the height direction of the cavity, wherein the first baffle is configured to cause the first heat exchange tube set to receive refrigerant from the refrigerant inlet, and the first baffle and the second baffle are configured to direct refrigerant from the first heat exchange tube set to the second heat exchange tube set via the horizontal fluid channel and the vertical fluid channel.

9. The condenser of claim 8, wherein, during operation of the condenser, the bottom end of the second baffle is at least partially immersed in liquid refrigerant.

10. The condenser of claim 8, wherein:

a first accommodating space is formed between the first baffle and the housing, the first heat exchange tube set is arranged in the first accommodating space, the first accommodating space has a first accommodating space inlet and a first accommodating space outlet, the first accommodating space inlet is in communication with the refrigerant inlet, and the first accommodating space outlet is in communication with the horizontal fluid channel.

11. The condenser of claim 8, wherein:

a second accommodating space is formed between the second baffle and the housing, the second heat exchange tube set is arranged in the second accommodating space, the second accommodating space has a second accommodating space inlet, and the second accommodating space inlet is in communication with the vertical fluid channel.

12. The condenser of claim 8, wherein:

the first baffle comprises a main body section and a guide section, the main body section extends in the height direction of the cavity, a top of the main body section is flush with a top of the first heat exchange tube set or exceeds the top of the first heat exchange tube set, the guide section extends upwardly from the top of the main body section and tilts toward a direction away from the first heat exchange tube set until being connected with the housing, and the guide section is disposed above the vertical fluid channel.

13. A condenser, comprising:

a housing, wherein the housing comprises a cavity, the cavity has a length direction, a width direction, and a height direction, and a refrigerant inlet and a refrigerant outlet are provided on the housing;

a first heat exchange tube set and a second heat exchange tube set, wherein the first heat exchange tube set is disposed, in the height direction of the cavity, above the second heat exchange tube set, two sides of the first heat exchange tube set in the width direction of the cavity are adjacent to the housing, and at least one side of two sides of the second heat exchange tube set in the width direction of the cavity is spaced at a distance from the housing; and at least one baffle, wherein the at least one baffle is disposed at a position close to the at least one side of the second heat exchange tube set spaced at the distance from the housing, a top end of the at least one baffle is not higher than the second heat exchange tube set in the height direction of the cavity, and a fluid space is formed between a side portion of the at least one baffle and the housing.

14. The condenser of claim 13, wherein:

a lower portion of the at least one baffle has a connection channel that allows a liquid refrigerant to pass through.

15. The condenser of claim 14, further comprising:

a guide plate, wherein the guide plate is arranged between the first heat exchange tube set and the second heat exchange tube set and covers the second heat exchange tube set, to guide the liquid refrigerant to flow to the fluid space, and vent holes are formed on the guide plate to allow a gaseous refrigerant to pass through.

16. The condenser of claim 15, wherein:

the guide plate comprises an inclined section, and the inclined section extends upwardly from the at least one baffle and towards a center line of the second heat exchange tube set in the width direction of the cavity.

17. The condenser of claim 16, wherein:

the vent holes are long strips extending along an inclined direction of the inclined section.

* * * * *